United States Patent [19]

Kinoshita

[11] Patent Number: 4,469,921

[45] Date of Patent: Sep. 4, 1984

[54] HORN TYPE LOUDSPEAKER

[75] Inventor: Shozo Kinoshita, Saitama, Japan

[73] Assignee: Pioneer Electronic Corporation, Tokyo, Japan

[21] Appl. No.: 356,546

[22] Filed: Mar. 9, 1982

[30] Foreign Application Priority Data

Mar. 17, 1981 [JP] Japan ..... 56-38866

[51] Int. Cl.[3] ..... H04R 1/30

[52] U.S. Cl. ..... 179/115.5 H; 181/187; 181/192

[58] Field of Search ..... 179/115.5 H; 181/192, 181/195, 187

[56] References Cited

U.S. PATENT DOCUMENTS

| | | | |
|---|---|---|---|
| 1,358,883 | 11/1920 | Seabrook | 181/192 |
| 2,537,141 | 1/1951 | Klipsch | 181/187 |
| 2,690,231 | 9/1954 | Levy | 181/192 |
| 3,930,561 | 1/1976 | Klauman | 181/192 |
| 4,171,734 | 10/1979 | Peveto | 181/195 |
| 4,176,731 | 12/1979 | Sinclair | 181/192 |

FOREIGN PATENT DOCUMENTS

| | | | |
|---|---|---|---|
| 138378 | 10/1979 | German Democratic Rep. | 181/192 |
| 57-76995 | 5/1982 | Japan | 179/115.5 H |
| 57-152792 | 9/1982 | Japan | 181/192 |

*Primary Examiner*—G. Z. Rubinson
*Assistant Examiner*—L. C. Schroeder
*Attorney, Agent, or Firm*—Sughrue, Mion, Zinn, Macpeak & Seas

[57] ABSTRACT

A sectoral horn type loudspeaker includes a throat section and a sectoral part where the width of the horn at the connection therebetween is less than the wavelength of the upper limit frequency. In order to make the sound pressure characteristic flat throughout the frequency range, the directivity angle is changed for frequency bands in correspondence to the horn driver energy conversion characteristic. In particular, the side walls of the horn are bent polygonally at at least one point to increase the opening angle stepwise.

4 Claims, 11 Drawing Figures

HORN TYPE LOUDSPEAKER

BACKGROUND OF THE INVENTION

This invention relates to a horn type loudspeaker, and more particularly to a horn type loudspeaker which is uniform in diffusion and excellent in frequency response on the axis thereof.

A horn type loudspeaker is made up of a driver which is the sound generating source, and a conical or sectoral horn connected to the driver. The horn type loudspeaker has been designed in various manners so as to improve the directivity thereof to thereby increase the listening range. One example of such a design is embodied in the sectoral horn. The side walls are linear, and the opening degree or angle of the horn is adjusted by the upper and lower curved walls. The diffusion is relatively uniform over the middle frequency range; however, the directivity is decreased abruptly with the upper limit frequency, which is defined by the configuration and dimensions of the horn throat. Furthermore, as the directivity angle decreases, the directivity gain DI is increased, and accordingly the sound pressure in the high frequency range on the axis of the horn is increased.

Recently, a horn type loudspeaker has been developed in which the directivity gain DI is made constant for all frequencies by making the directivity angle uniform. However, since the energy conversion characteristic of the driver is lowered in the high frequency range, this horn type loudspeaker still has a problem in that, with the constant directivity gain DI, the sound pressure characteristic on the axis is lowered in the high frequency range.

SUMMARY OF THE INVENTION

Accordingly, an object of this invention is to provide a horn type loudspeaker which has excellent tonal qualities and has a wide listening range.

In order to achieve the foregoing object, in the invention, the directivity angle is changed for every frequency band in correspondence to the energy conversion characteristic of the driver so that the directivity gain DI is changed so as to compensate for the energy conversion characteristic, thereby to make the sound pressure characteristic on the axis of the horn flat and prevent an abrupt change in the directivity.

BRIEF DESCRIPTION OF THE DRAWINGS

The horn type loudspeaker according to the invention will be described with reference to the accompanying drawings, in which.

DETAILED DESCRIPTION OF THE PREFERRED EMBODIMENTS

Figure 1:
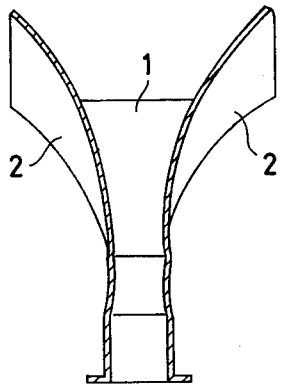
FIG. 1 is a side sectional view of a sectoral horn type loudspeaker in accordance with the present invention.
Figure 2:
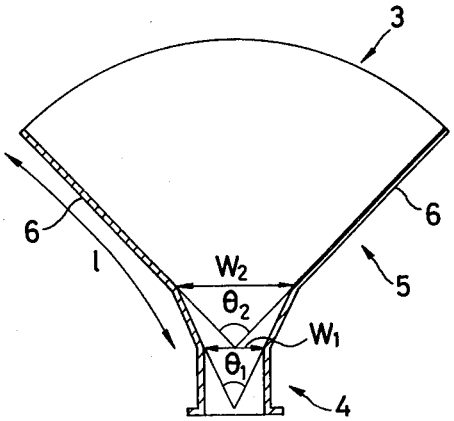
FIG. 2 is a front sectional view showing the essential components of the horn shown in FIG. 1.
Figure 3:
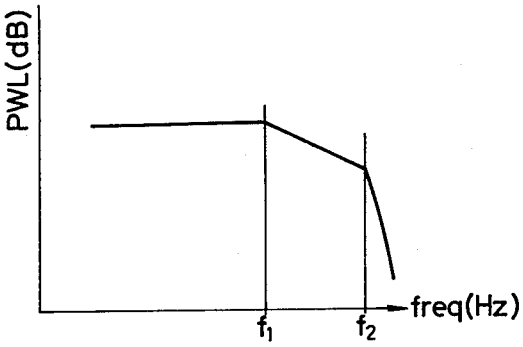
FIGS. 3, 5, and 7 through 11 are graphical representations indicating the characteristics of the horns of FIGS. 2, 4, and 6.

FIGS. 1 and 2 are sectional views showing the horn of one example of a horn type loudspeaker according to this invention. The horn 3 is a sectoral horn comprising linear side walls 1, upper and lower curved walls 2, a horn throat 4 and a sectoral part 5. The width W1 at the connection of the throat 4 and the sectoral part 5 is smaller than the wavelength of the upper limit frequency. The side walls 6 of the horn are bent like a polygonal line, so that the opening angle $\theta$ is increased stepwise. More specifically, the horn has an opening angle $\theta_1$ at the width W1, and an opening $\theta_2$ at the width W2 of the horn. As shown in FIG. 1, the sectional area of the horn 3 may be changed by forming the upper and lower walls curvilinearly. In the case of a driver for the horn 3, the widths W1 and W2 are set to the wavelengths of frequencies f1 and f2, respectively, as shown in FIG. 3.

Figure 4:
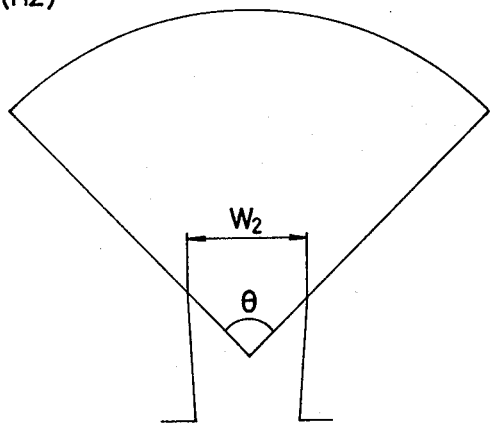
FIGS. 4 and 6 are schematic diagrams showing conventional horns.
Figure 8:
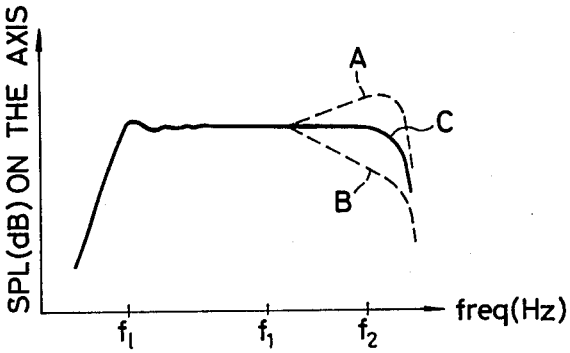
Figure 9:
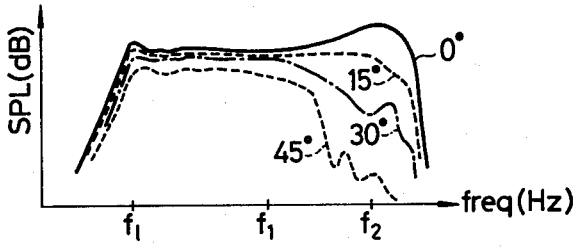
Figure 10:
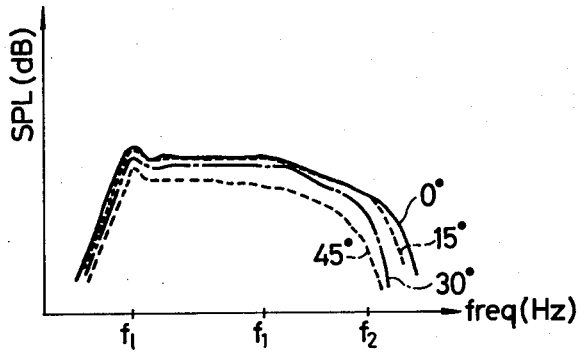

Before describing the characteristics of the horn shown in FIG. 2, the factors for determining the directivity of a sectoral horn will be described. There are two factors for determining the sectoral horn directivity, one being the angle $\theta$ between both side walls. The diffusion is substantially uniform within the angle in the case of frequencies f1 or higher, up to a frequency the wavelength of which is equal to the length l of the side walls. On the other hand, in the case of frequencies higher than those corresponding to the wavelength equal to the width at the connection of the throat and the sectoral part, the wave surface of a sound wave, which is radiated sectorally from the horn throat, becomes like a beam, therefore the interior of the horn is not uniformly filled with the sound wave, and the directivity angle becomes smaller than $\theta$. In addition, as the frequency increases, the beam width is abruptly decreased. Accordingly, if, in an ordinary sectoral horn, the width at the junction of the horn throat and the sectoral part is set to W2 as shown in FIG. 4, then the directivity angle is as indicated by the characteristic curve A in FIG. 5; and if the width is set to W1 as shown in FIG. 6, then the directivity angle is as indicated by the characteristic curve B in FIG. 5. As the directivity angle changes, the directivity gain DI is changed as indicated by the characteristic curves A and B in FIG. 7. The characteristic curve A is of an ordinary sectoral horn, and the characteristic curve B is for an example in which the directivity angle in the frequency band is unified. When a driver having the characteristic as shown in FIG. 3 is combined with a horn having the above-described characteristics, then the frequency response of the horn on the axis is not flat, as indicated by the characteristic curves A and B in FIG. 8. In this case, the directivity is as shown in FIG. 9 with respect to the characteristic curve A, and is as shown in FIG. 10 with respect to the characteristic curve B. Both cases are undesirable.

Figure 5:
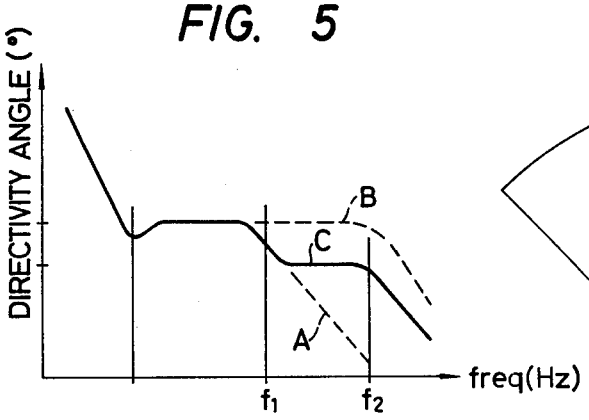
Figure 6:
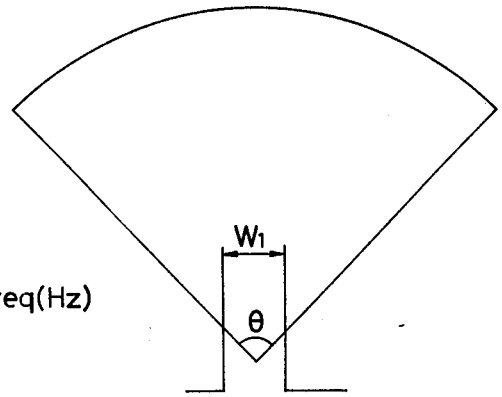
Figure 7:
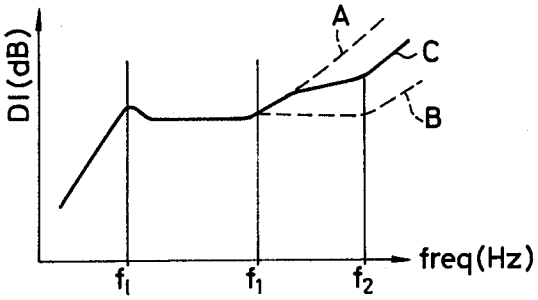
Figure 11:
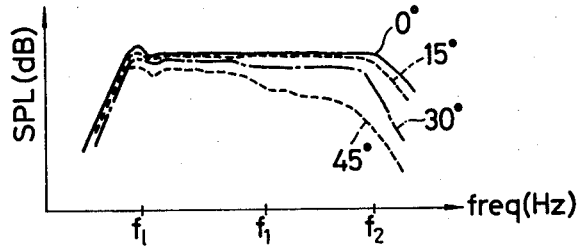

On the other hand, the directivity angle of the horn 3 shown in FIG. 2 is as indicated by the characteristic curve C in FIG. 5, and the directivity gain DI is as indicated by the characteristic curve C in FIG. 7; that is, it changes in two steps with frequencies lower than f2. Therefore, by combining the horn with the driver having the characteristic shown in FIG. 3, the frequency response of the horn on the axis becomes flat as indicated by the characteristic curve C in FIG. 8. In this case, the directivity is improved in the necessary frequency band, as shown in FIG. 11. Accordingly, the necessary listening range can be obtained by suitably setting the angle $\theta_1$ to a low but necessary limit value, and the angle $\theta_2$ to a necessary and sufficient value.

In the above-described example of the horn according to the invention, each side wall is bent at one point;

however, it goes without saying that the invention is not limited thereto or thereby.

As is apparent from the above description, in the sectoral horn according to the invention, a frequency response is given to the directivity angle by suitably bending the side walls. Therefore, the frequency response on the axis of the horn is flat, and the tonal quality is improved. In the invention, the tonal quality is uniform within the set listening range, and therefore uniform excellent tone quality can be provided for many listeners scattered over a wide area. Furthermore, the invention has the excellent effect that a smooth frequency response can be readily obtained at low cost, without using fins or the like which are likely to cause reflection.

What is claimed is:

1. A horn type loudspeaker, comprising: a sectoral horn having sidewalls, a driver, a throat section having equal sized circumferential openings at its ends and connected between said horn and driver, said horn having sidewalls joining said throat section at a juncture, said sidewalls being outwardly bent in a polygonal manner so as to alter an opening angle of said horn whereby a frequency response of a directivity angle and directivity gain of said loudspeaker are selected so as to compliment an energy conversion characteristic of said driver, to render a frequency response of said loudspeaker flat.

2. A loudspeaker as claimed in claim 1, said opening angle of said horn being increased stepwise at said juncture and at at least one point of said sectoral section.

3. A loudspeaker as claimed in claim 1, said horn having a width W at said juncture of said throat section and said sectoral section such that said width is smaller than the wavelength corresponding to the upper limit frequency of the loudspeaker.

4. A horn type loudspeaker, comprising: a horn having sidewalls, a driver having an energy conversion characteristic variable with frequency, and a throat section having equal-sized circumferential openings at its ends and connected between said sidewalls and driver, said sidewalls being stepwise bent at at least one point to stepwise increase an opening angle of said horn and give a directivity angle of said horn a frequency response in correspondence to said driver characteristic so as to change a directivity gain to compensate for said driver characteristic, whereby a sound pressure characteristic on an axis of said horn is made flat.

* * * * *